US006390587B1

(12) United States Patent
Subirada

(10) Patent No.: US 6,390,587 B1
(45) **Date of Patent: *May 21, 2002**

(54) CALIBRATION SYSTEM AND METHOD SCANNING REPEATED SUBSETS OF PRINT TEST PATTERNS HAVING COMMON COLOR REFERENCE MARKINGS

(75) Inventor: Francesc Subirada, Barcelona (ES)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/034,866

(22) Filed: Mar. 4, 1998

(51) Int. Cl.[7] ..... B41J 29/393

(52) U.S. Cl. ..... 347/19

(58) Field of Search ..... 347/19

(56) References Cited

U.S. PATENT DOCUMENTS

| | | | | | |
|---|---|---|---|---|---|
| 4,449,052 | A | * | 5/1984 | Krieg | 347/19 X |
| 5,451,990 | A | * | 9/1995 | Sorenson et al. | 347/19 X |
| 5,530,460 | A | * | 6/1996 | Wehl | 347/19 |
| 5,835,108 | A | * | 11/1998 | Beauchamp et al. | 347/19 |
| 5,975,674 | A | * | 11/1999 | Beauchamp et al. | 347/19 |
| 6,109,722 | A | * | 8/2000 | Underwood et al. | 347/19 |
| 6,164,750 | A | * | 12/2000 | Subirada et al. | 347/19 |
| 6,196,652 | B1 | * | 3/2001 | Subirada et al. | 347/19 |

* cited by examiner

*Primary Examiner*—Fred L Braun

(57) ABSTRACT

A test pattern is printed and thereafter scanned with a carriage-mounted optical sensor in order to automatically calibrate relative location and alignment between the separate printheads such as CYMK printheads in both the X-axis (media advance) and the Y-axis (carriage scan). To improve the precision of the calibration, the system and method employ small subset groupings of multiple test pattern samples with common reference markings. Each different test pattern is formed by multiple pairs of spaced-apart bars printed by each printhead in a subset associated with a common reference mark such as a magenta reference bar, and the resulting optically sensed measurements may then be averaged over the entire pattern.

19 Claims, 20 Drawing Sheets

MISALIGNED PENS

USUAL PEN ALIGNMENT

SH OPTIMIZED PEN ALIGNMENT

SCAN AXIS DIRECTIONALITY WARMING
208d
MEDIA AXIS ALIGN WARMING
208c
SCAN AXIS ALIGN WARMING
BI-DI WARMING
208b
208a

19B
BLACK
208
19A
YELLOW
MAGENTA
CYAN
206
210
Y ALIGN
K ALIGN
C ALIGN
214(Y)
212(M)
214(M)
214(C)
214(K)
BI-DI ALIGNMENT PATTERN 200
202
204
SLOW K
FAST K
SCAN AXIS PEN ALIGNMENT PATTERN

CALIBRATION SYSTEM AND METHOD SCANNING REPEATED SUBSETS OF PRINT TEST PATTERNS HAVING COMMON COLOR REFERENCE MARKINGS

CROSS-REFERENCE TO RELATED APPLICATIONS

The present application is related to the following co-pending commonly assigned applications, all of which are incorporated herein by reference: U.S. Ser. No. 08/585,051 filed Jan. 11, 1996 by Cobbs et al. entitled MULTIPLE INKJET PRINT CARTRIDGE ALIGNMENT BY SCANNING A REFERENCE PATTERN AND SAMPLING SAME WITH REFERENCE TO A POSITION ENCODER; U.S. Ser. No. 08/811,406 filed Mar. 4, 1997 by Garcia et al entitled OPTICAL ENCODING OF PRINTHEAD SERVICE MODULE; and U.S. Ser. No. 09/031,115 by Maza et al, filed on Feb. 26, 1998 entitled METHOD AND APPARATUS FOR LOCATING AN INKJET PRINTER CARRIAGE RELATIVE TO A SERVICE STATION.

FIELD OF THE INVENTION

The present invention relates to printing and scanning test patterns which are used for various calibration adjustments of multiple-printhead inkjet printing systems.

BACKGROUND TO INVENTION

Inkjet cartridges are now well known in the art and generally comprise a body containing an ink supply and having electrically conductive interconnect pads thereon and a printhead for ejecting ink through numerous nozzles in a printhead. In thermally activated inkjet cartridges, each cartridge has heater circuits and resistors which are energised via electrical signals sent through the interconnect pads on the cartridge. Each inkjet printer can have a plurality, often four, of cartridges each one having a different colour ink supply for example black, magenta, cyan and yellow, removably mounted in a printer carriage which scans backwards and forwards across a print medium, for example paper, in successive swaths. When the printer carriage correctly positions one of the cartridges over a given location on the print medium, a jet of ink is ejected from a nozzle to provide a pixel of ink at a precisely defined location. The mosaic of pixels thus created provides a desired composite image.

When multiple printheads are used, it is desirable to provide calibration techniques for alignment adjustments between different printheads as well as between different nozzle arrays in the same printhead.

BRIEF SUMMARY OF THE INVENTION

The present invention provides a technique for adjustable alignment of multiple inkjet printhead cartridges removably mounted on a scanning printer carriage of an inkjet printer by printing and scanning multiple test patterns. The apparatus comprises means for determining the position of the printer carriage along its scanning direction (such as an encoder strip), an optical sensor mounted on the printer carriage and various calibration test patterns which are optically detectable by the optical sensor. Although an optical sensor mounted on the printer carriage of an inkjet printer is known to be useful for a number of purposes related to the scanning of test patterns printed in the print zone of the printer, the present invention extends the usefulness of such an optical sensor for additional types to calibration patterns.

Preferably, the optical sensor is able to distinguish between the reflectance of sensed objects and multiple reference bars of each different color produce changes of reflectance in the scanning direction of the printer carriage as well as in the media advance axis.

According to a further aspect of the present invention there is provided a method of locating a scanning printer carriage of an inkjet printer relative to a series of horizontally or vertically spaced-apart bars, activating an optical sensor mounted on the printer carriage, moving the printer carriage along in its scanning direction or scanning along the media advance axis while optically sensing the bars forming the test pattern, and storing for future use the position of the printer carriage at which the reference mark has been located.

Preferably the process of calibrating the location of the printer carriage is performed several times and between each printhead periodically as needed, as, for example, whenever a new print cartridge (also called "pen" herein) is installed.

A more complete understanding of the present invention and other objects, aspects, aims and advantages thereof will be gained from a consideration of the following description of the preferred embodiment read in conjunction with the accompanying drawings provided herein.

DETAILED DESCRIPTION OF THE PREFERRED EMBODIMENT OF THE INVENTION

Figure 1:
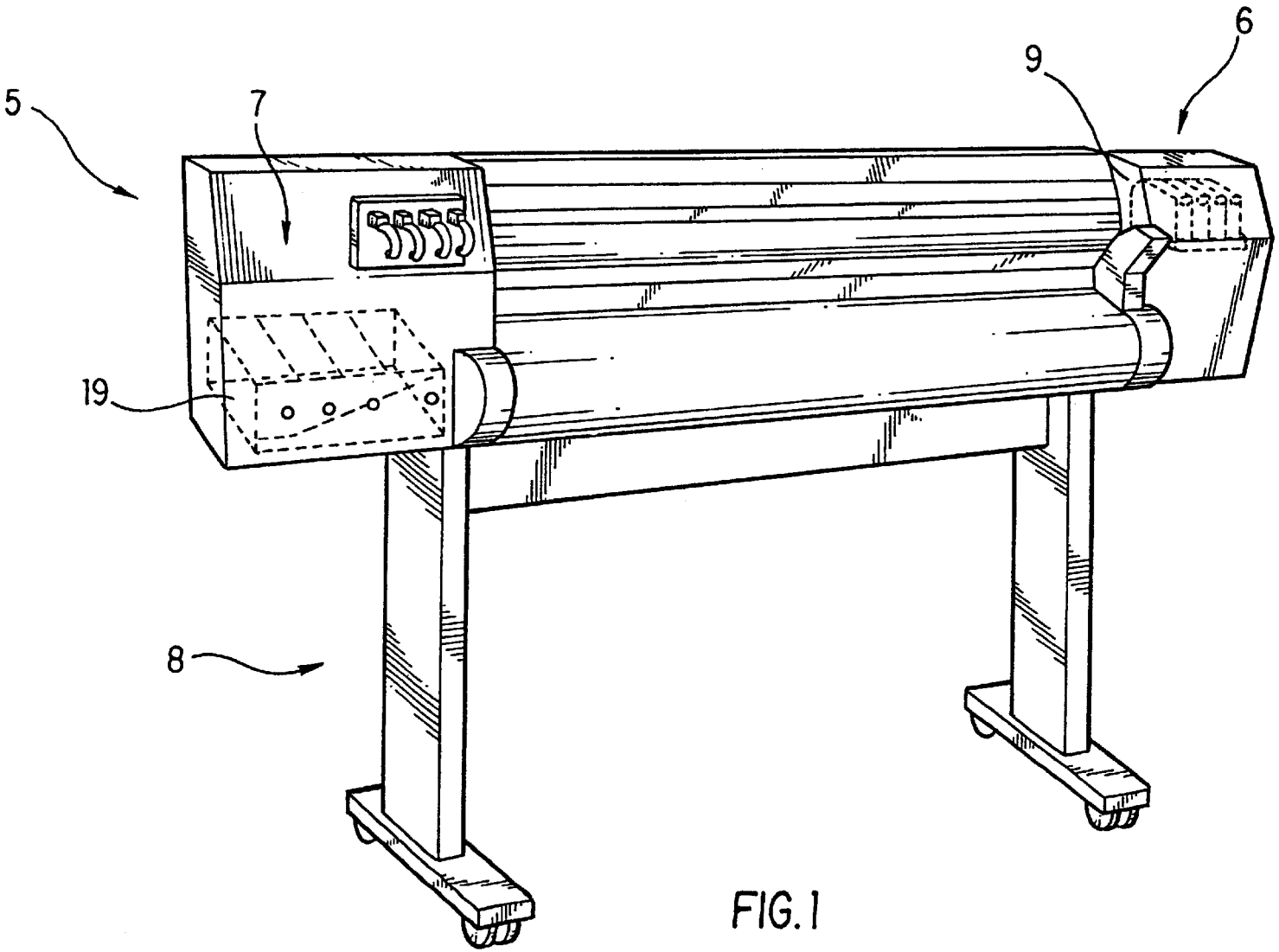
FIG. 1 is a perspective view of a large-format inkjet printer with which the location system of the present invention may be utilised.

While the present invention is open to various modifications and alternative constructions, the preferred embodiments shown in the drawings will be described herein in detail. It is to be understood, however, that there is no intention to limit the invention to the particular form disclosed. On the contrary, the intention is to cover all modifications, equivalences and alternative constructions falling within the spirit and scope of the invention as expressed in the appended claims.

It will be appreciated that the printer carriage to service station location system of the present invention may be used with virtually any inkjet printer, however one particular inkjet printer will first be described in some detail, before describing the location system of the invention.

FIG. 1 shows a perspective schematic view of a thermal inkjet large-format printer having a housing 5 with right and left covers respectively 6 and 7, mounted on a stand 8. A print media such as paper is positioned along a vertical or media axis by a media axis drive mechanism (not shown). As is common in the art, the media drive axis is denoted as the X axis and the printer carriage scan axis is denoted as the Y axis.

Figure 2:
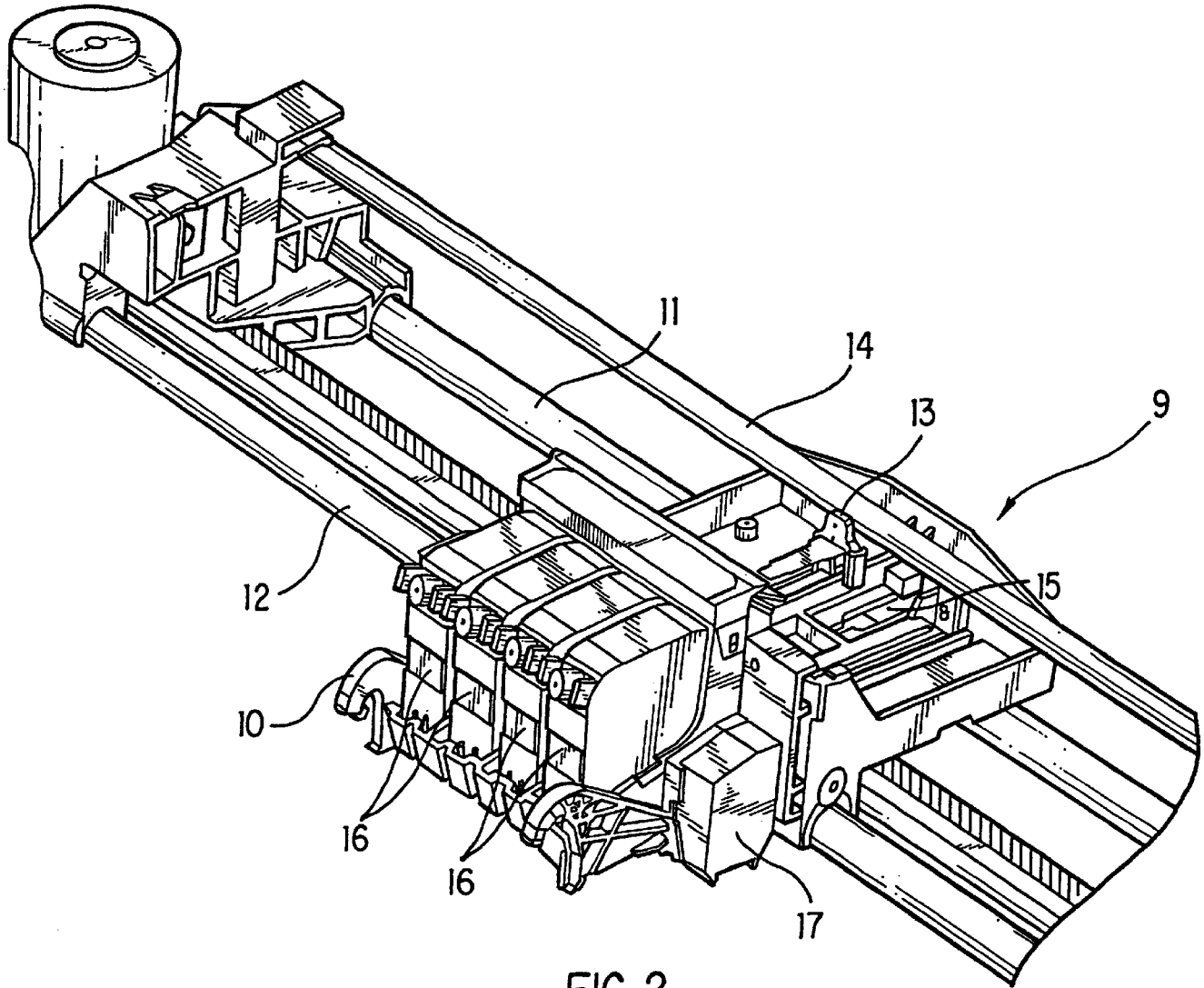
FIG. 2 is a schematic drawing of components within the print zone of the printer of FIG. 1.
Figure 3:
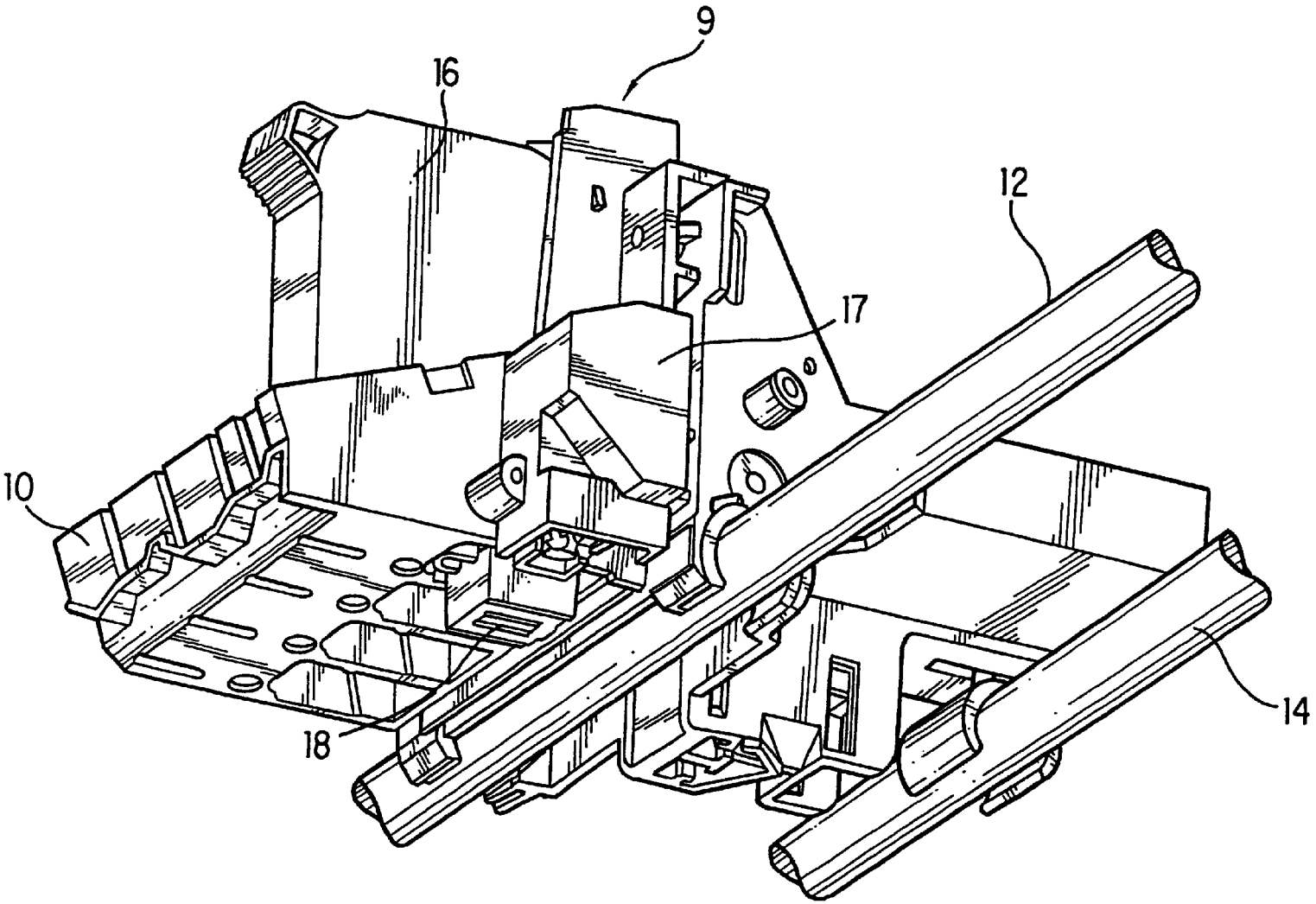
FIG. 3 is a side bottom view of the carriage assembly of the printer of FIG. 1.

The printer has a carriage assembly 9 shown in phantom under cover 6 and more clearly in FIG. 2 which is a perspective view of the print zone of the printer. The carriage assembly 9 has a body which is mounted for reciprocal movement along slider rods 11 and 12 and a printer carriage 10 for holding four inkjet cartridges 16 each holding ink of a different colour for example black, yellow, magenta and cyan. The cartridges are held in a close packed arrangement and each may be selectively removed from the printer carriage 10 for replacement by a fresh cartridge. The printheads of the cartridges 16 are exposed through openings in the printer carriage 10 facing the print media. On the side of the printer carriage 10 is mounted an optical sensor 17 which will be described in greater detail below. The carriage assembly body further retains an optical encoder 13 for determining the position of the printer carriage in the Y axis by interaction with an encoder strip 14, and the circuitry 15 required for interface to the heater circuits in the inkjet cartridges 16. FIG. 3 is a side-bottom perspective view of the carriage assembly 9 which better shows the mounting of the carriage and the protrusion of a printhead 18 of an inkjet cartridge 16 through the printer carriage 10 towards the print media.

Figure 6A:
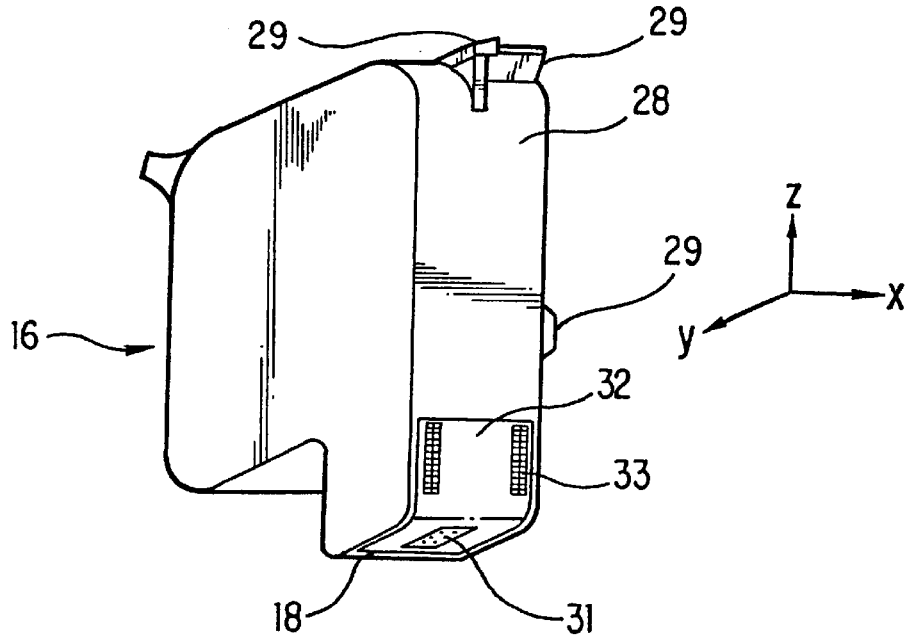
FIGS. 6A and 6B show an inkjet cartridge which may be used with the location system of the present invention.
Figure 6B:
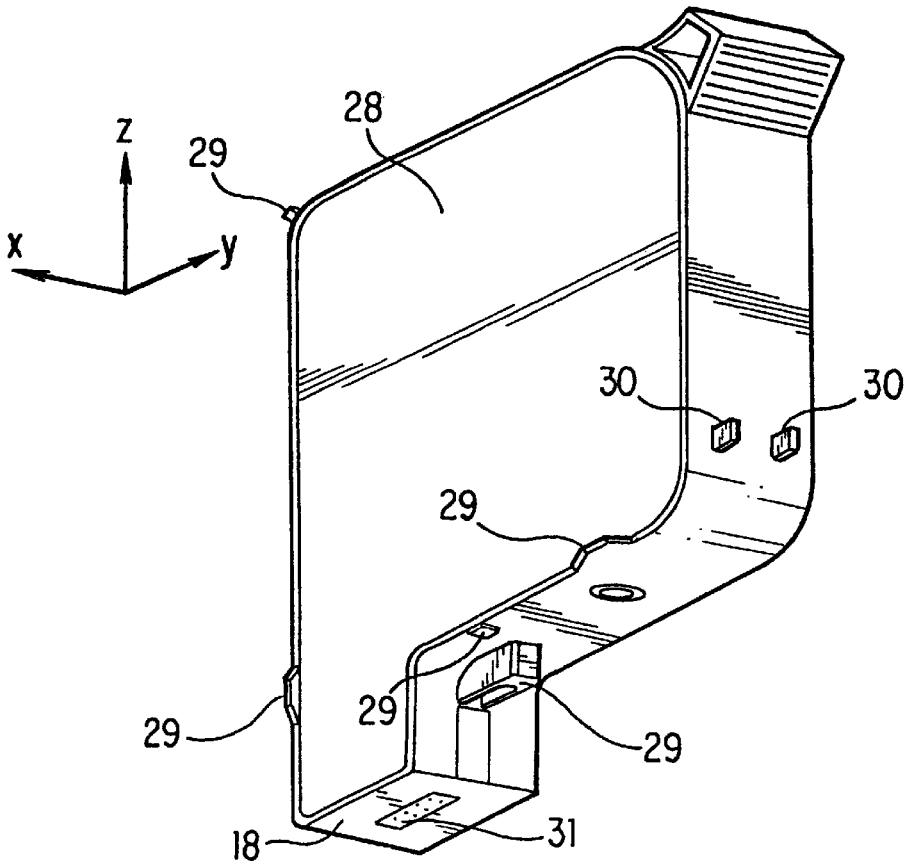

FIGS. 6A and 6B show details of an inkjet cartridge 16 which can be used with the printer shown in FIG. 1. The cartridge has a body 28 having an internal ink supply and various alignment features or datums 29, and keying elements 30. The printhead 18 has a nozzle plate 31 and an insulating tape 32 having electrically conductive interconnect pads 33 thereon.

Figure 4:
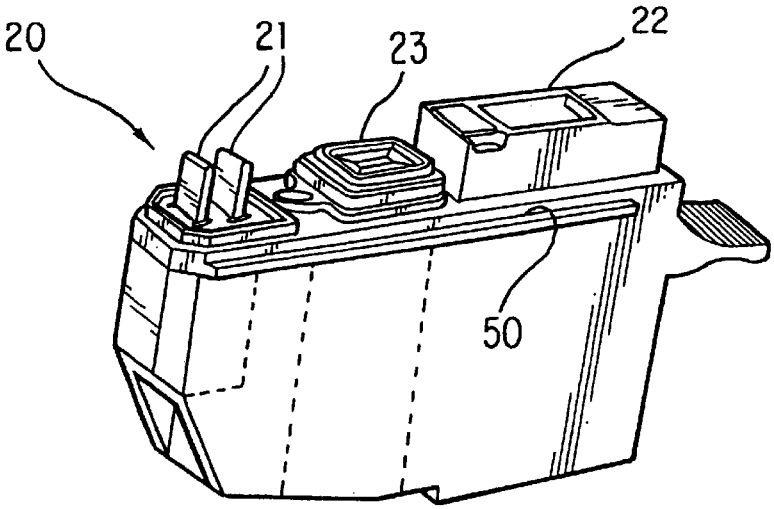
FIG. 4 is a perspective view of a service module having a cap, wipers and a spittoon which may be used with the location system of the invention.

Referring again to FIG. 1 the printer has a set of replaceable ink supply modules 19 in the lefthand side of the printer (shown in phantom under the cover 7) and a set of replaceable service station modules mounted in the service station at the right-hand side of the printer (not shown). FIG. 4 shows a service station module 20 having three servicing components, namely dual wipers 21 at one end, a spittoon 22 at the other end and a cap 23 at an intermediate position. The printer has one service station module 20 per cartridge 16 and each service station module is mounted in a service station carriage 24, shown in FIG. 5, in the service station unit 25 of the printer. The service station carriage 24 has four slots 26 for receiving service modules 20. Each of the slots 26 of the service station carriage 24 has a Z datum ridge 51 (shown in FIG. 8) along a top portion of the slot which engages a corresponding datum ledge 50 (as shown in FIG. 4) along both top edges of the service module 20. Each slot 26 also comprises an upwardly biased spring arm (not shown) which ensures that each service module 20 snaps into place in its respective slot 26 and is held against the datum ridge 51.

Figure 5:
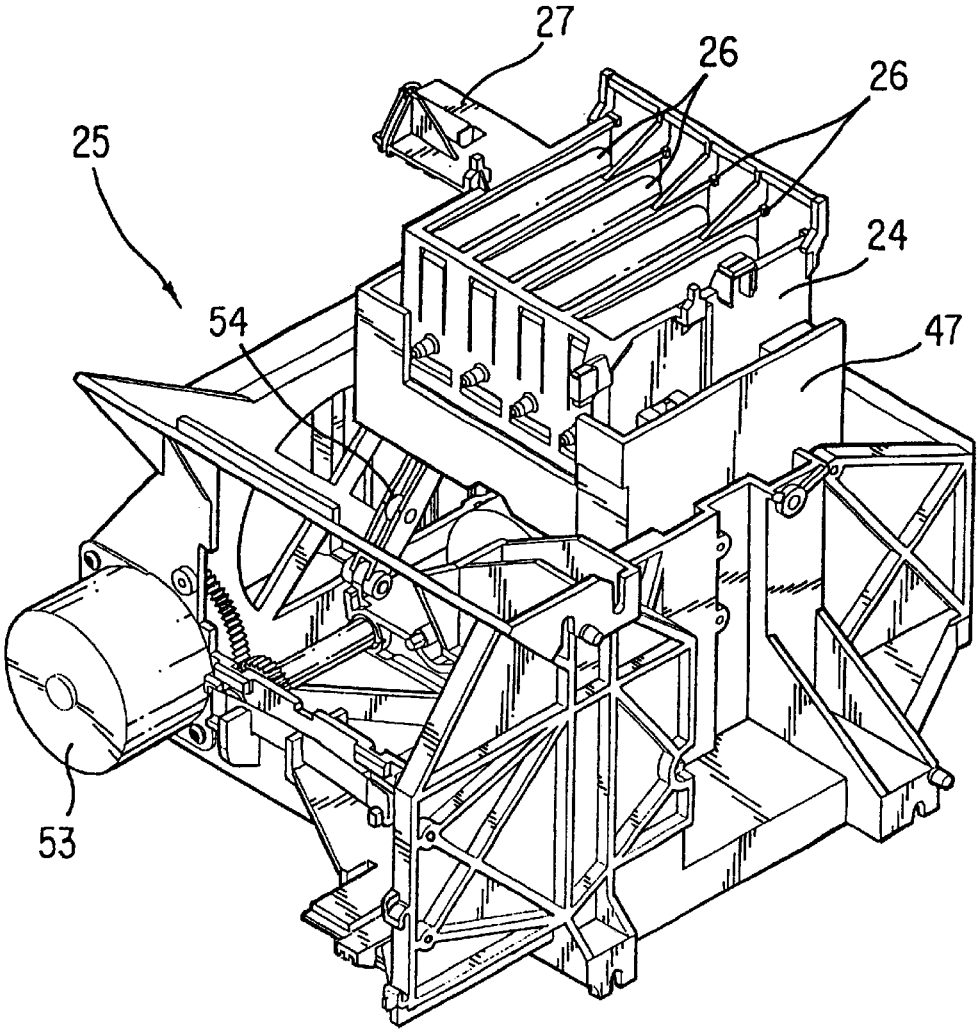
FIG. 5 is a perspective rear view of the service station unit of the printer of FIG. 1.
Figure 7:
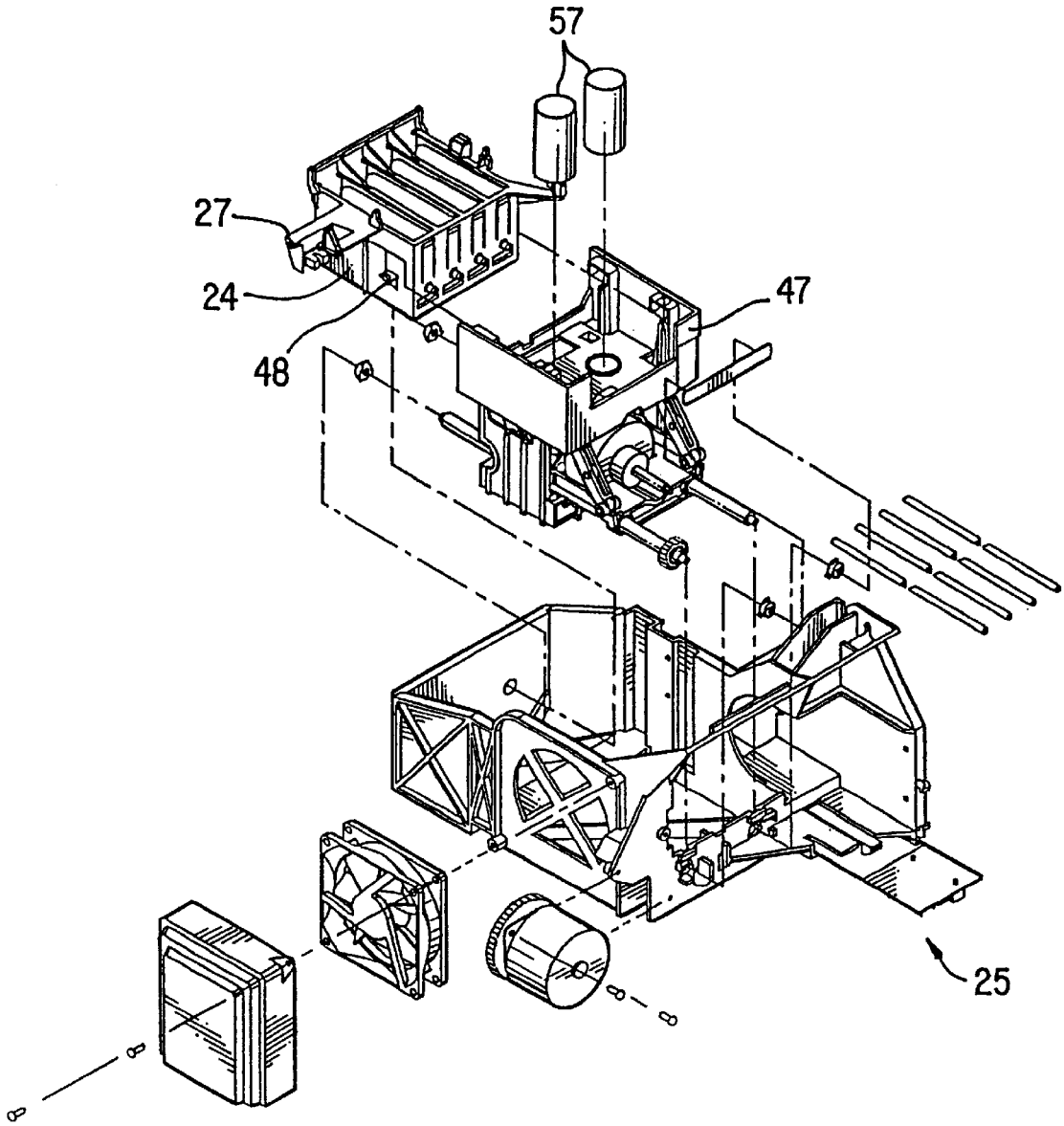
FIG. 7 is an exploded view of the service station unit of the printer of FIG. 1.

With reference to FIGS. 5 and 7, the service station carriage 24 is mounted within a service station assembly 47. As best seen in the exploded view of the service station unit 25 shown FIG. 7, the service station carriage 24 is mounted on two springs 57 within the service station assembly 47. The service station carriage 24 has four pegs 48, two extending from each of its outer side walls 49, (shown in FIG. 8) which abut downwardly facing arms 55 extending from the inner side walls 56 (shown in FIG. 9) of the service station assembly 47. The service station carriage 24 is upwardly biased by the springs 57 acting against its base 52 until the pegs 48 on its walls 49 contact the arms 55 of the service station assembly 47. This provides a "floating" mounting to the service station carriage 24 and allows it to gimbal to some extent to mate with the printer carriage 10 during capping.

Figure 9:
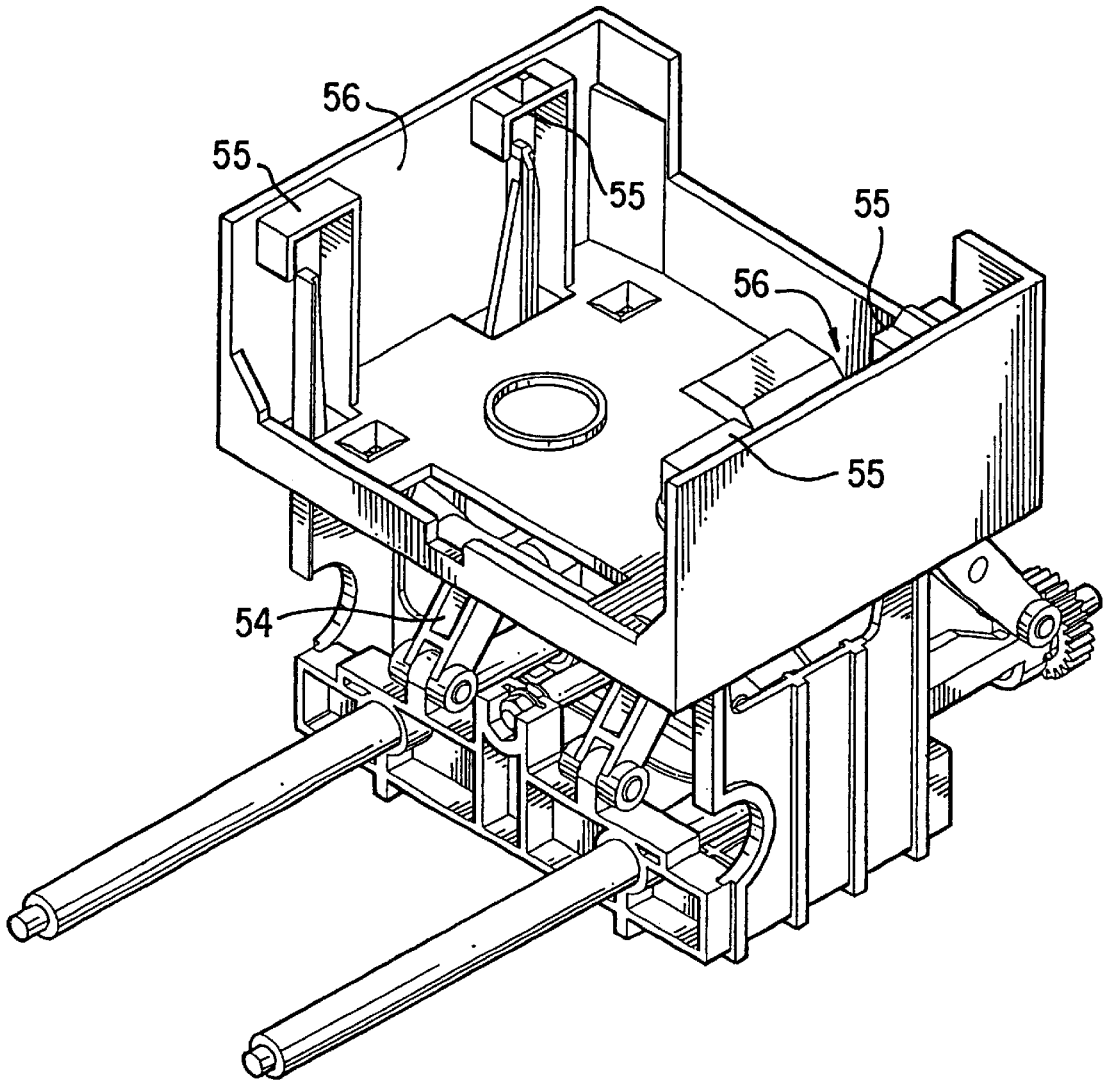
FIG. 9 shows a service station assembly on which the service station carriage of FIG. 8 is mounted.
Figure 10:
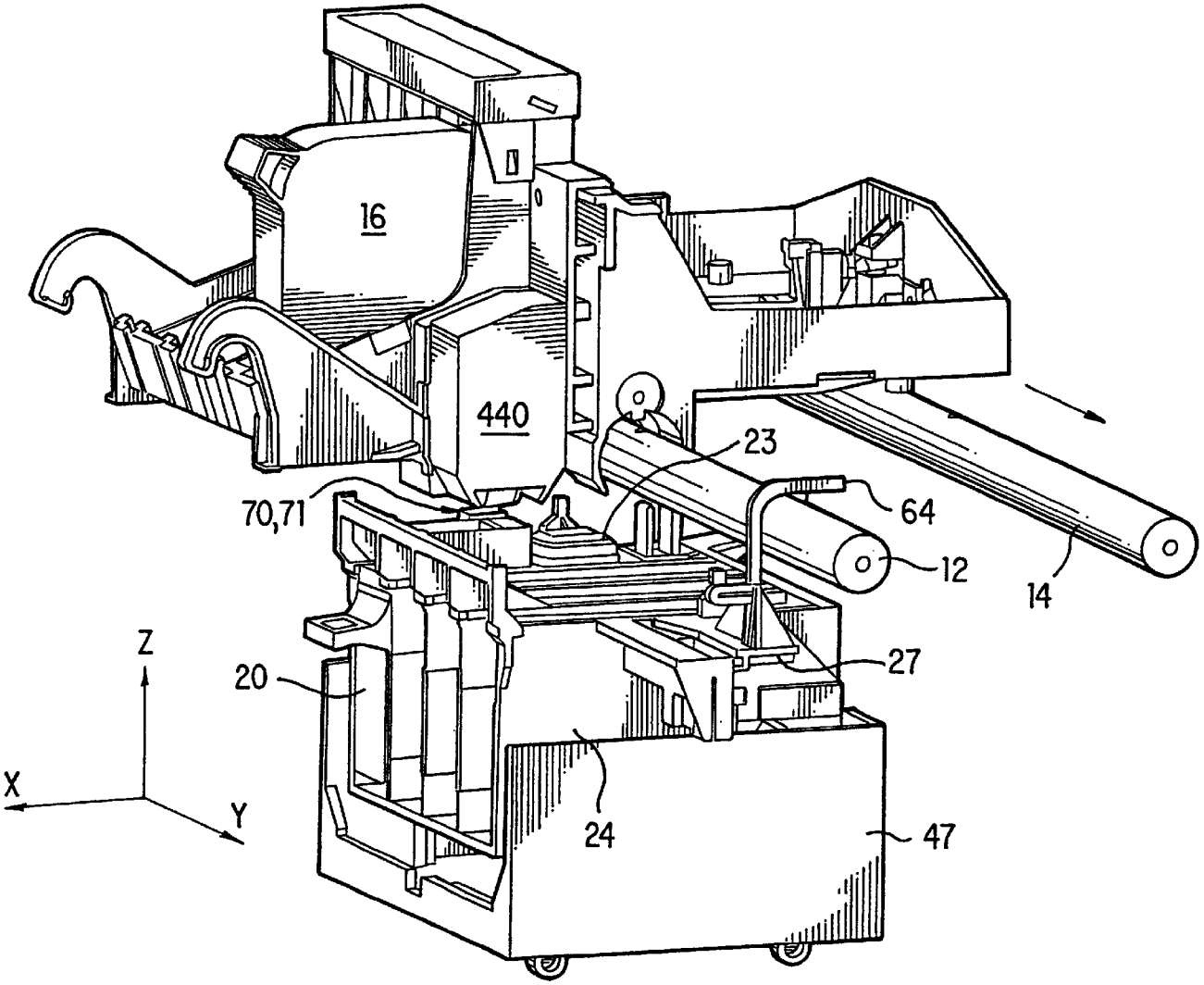
FIG. 10 shows the carriage assembly, including the printer carriage moving in the Y direction along slider rods to the right hand side of the printer where the service station is located.
Figure 11A:
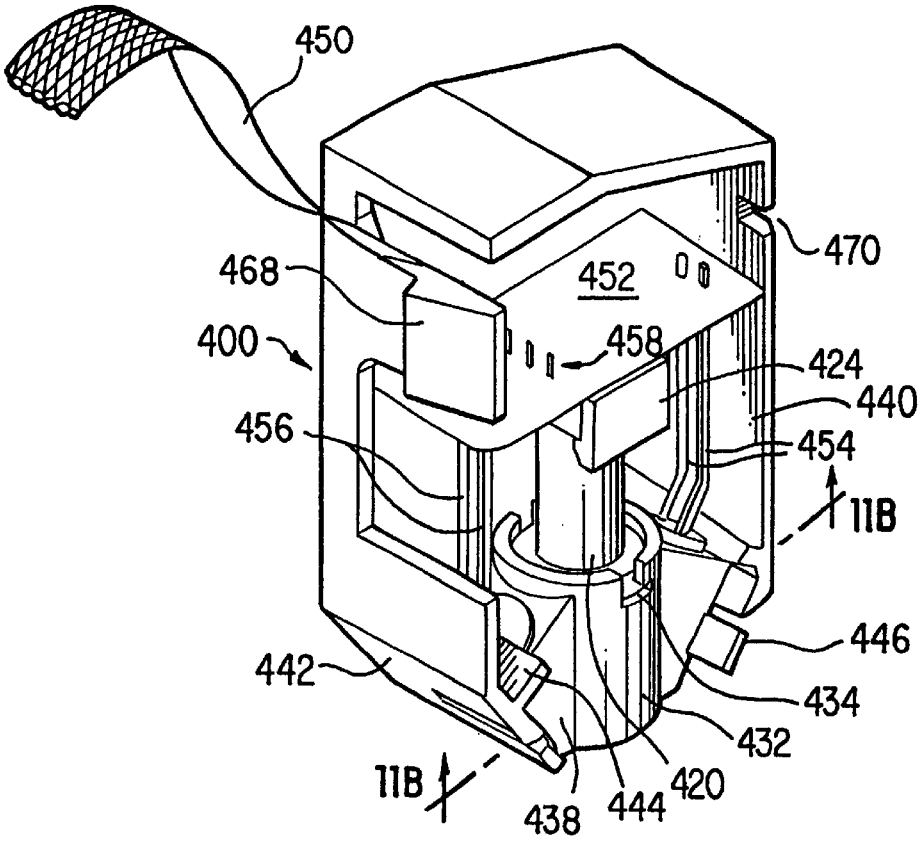
FIG. 11A is an isometric view showing the internal components of an optical sensor which is mountable on the printer carriage.
Figure 11B:
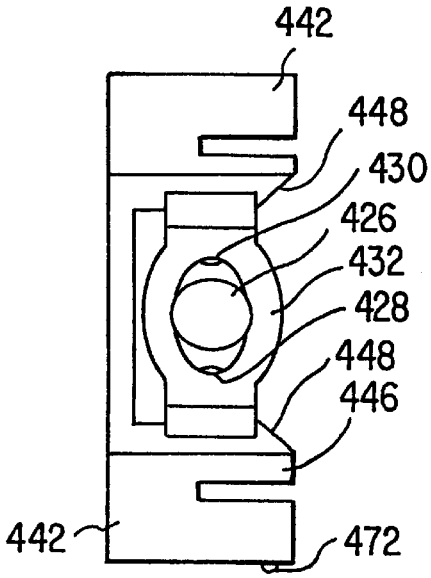
FIG. 11B is a bottom view of the optical sensor taken along the line 11B—11B of FIG. 11A.
Figure 12:
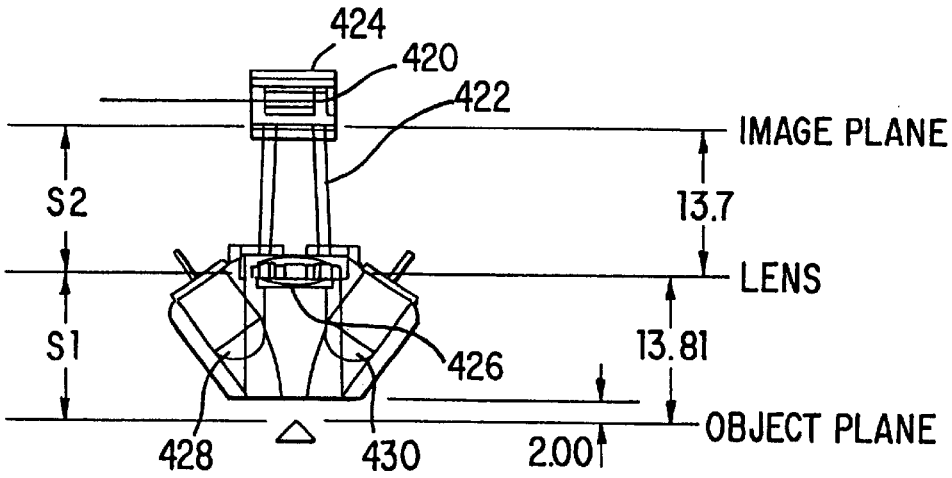
FIG. 12 is a front view of the components of the optical sensor of FIG. 11A.

The whole of the service station carriage 24 is moved in two directions, the X and Z directions, by the service station unit 25 so that various of the servicing components of the service modules 20 may be brought up to the printheads 18 of the cartridges 16 when required for servicing. Referring to FIGS. 5 and 9 the service station assembly 47 is movable in the X direction by a stepper motor 53 which drives a worm drive, and in the Z direction (i.e. the capping direction) by a second stepper motor (not shown) via a linkage 54. The position of the service station carriage 24 in the X and Z directions is determined by counting the stepper motors. This count is initialised in both the Z and the X directions by detecting the contact of a mechanical motion sensor, in the shape of an inverted L, 64 mounted on an arm 27 extending from the side of the service station carriage 24, with the front slider bar 12, as shown in FIG. 10. Since the printer carriage 10 is clearly well referenced to the slider bar (for printing purposes), by referencing the service station carriage location to the slider bar too the two carriages are well referenced to each other in the X and Z directions.

FIG. 10 shows the carriage assembly, including the printer carriage 10 (shown holding only one rather than four cartridges for clarity) moving in the Y direction along the slider rods 12 and 14 to the right hand side of the printer where the service station is located. Also shown are the service station assembly 47 and the service station carriage 24 holding only one rather than four service modules 20 again for the sake of clarity and the optical sensor 17.

Referring now to FIGS. 10, 11A, 11B and 12, the optical sensor 17 includes a photocell 420, holder 422, cover 424, lens 426, and light source such as two LEDs 428, 430. A unitary light tube or cap 432 has a pair of notched slots 434 which engage matching tabs on a lower end of the holder 422 upon insertion and relative rotation between the cap and the holder. The two LEDs are held in opposite apertures of the two shoulders 438 which have a size slightly less than the outside diameter of the LEDs, to prevent the LEDs from protruding into a central passageway which passes through the holder to the photocell. A protective casing 440 which also acts as an ESD shield for the sensor components is provided for attachment to the carriage as well as for direct engagement with the shoulders of the light tube. Additional details of the function of a preferred optical sensor system are disclosed in copending application Ser. No. 08/551,022 filed Oct. 31, 1995 entitled OPTICAL PATH OPTIMIZATION FOR LIGHT TRANSMISSION AND REFLECTION IN A CARRIAGE-MOUNTED INKJET PRINTER SENSOR, which application is assigned to the assignee of the present application, and is hereby incorporated by reference.

Figure 8:
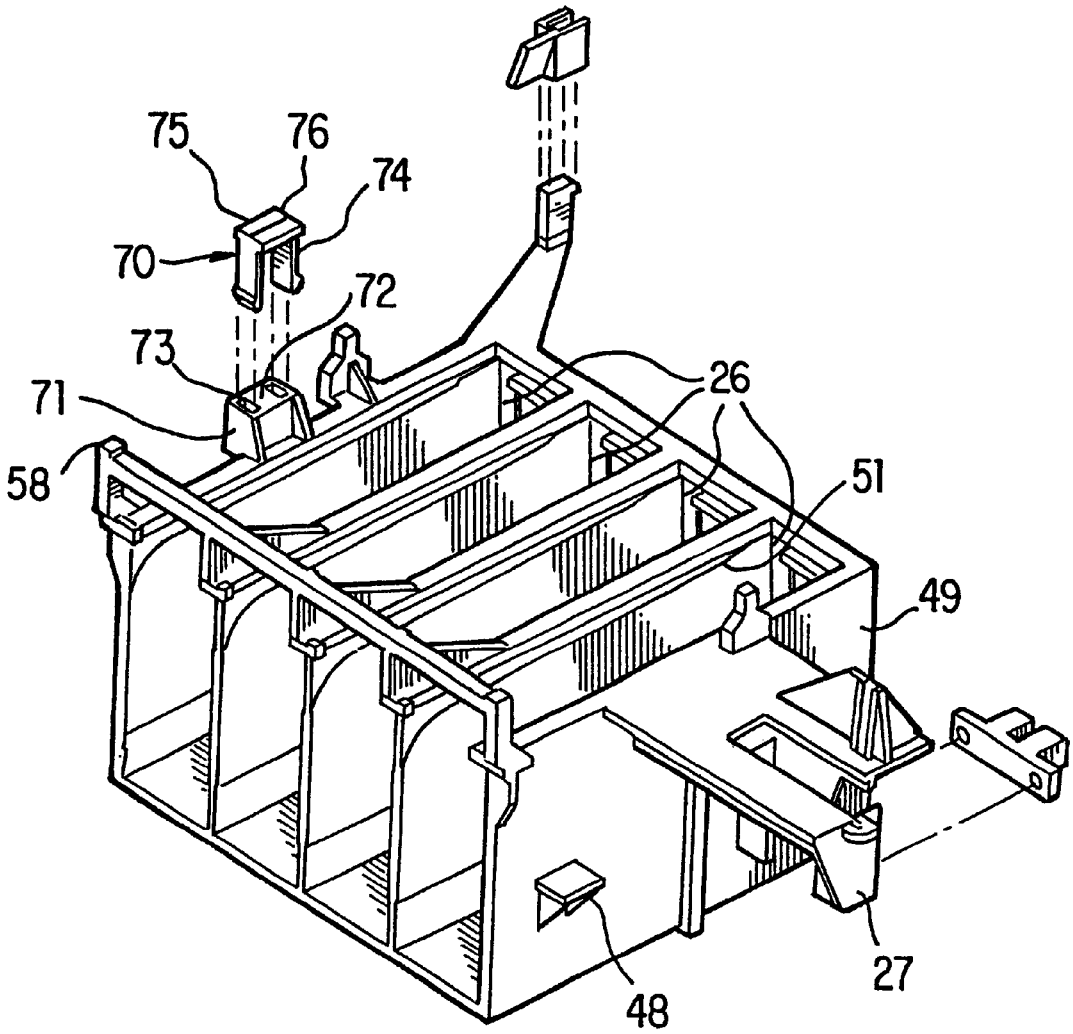
FIG. 8 shows a service station carriage incorporating a reference mark according to an embodiment of the present invention.
Figure 13:
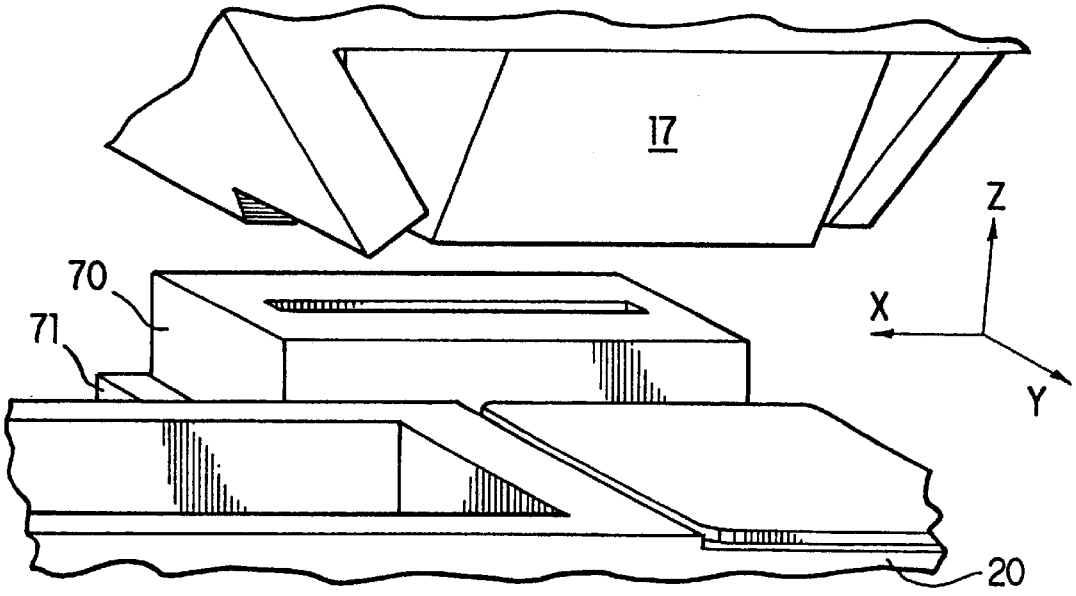
FIG. 13 is an enlarged partial perspective view of a part of the optical sensor and a reference mark according to an embodiment of the invention.

FIGS. 8 and 13 show a two part reference mark formed of an insert 70 and a mount 71 utilised in the presently preferred embodiment of the invention. The reference mark is located on the top of the left hand side wall 49 of the service station carriage 24 approximately midway along the length of the wall. This position is chosen so that the reference mark can be easily moved into the path of the optical sensor 17 as it is moved (on the printer carriage 10) along the slider bars in the Y direction. This movement of the reference mark to a position where it can be utilised for calibration according to the present embodiment is achieved by movement of the service station carriage 24 in the X and Z direction by the service station carriage assembly 47.

Figure 14:
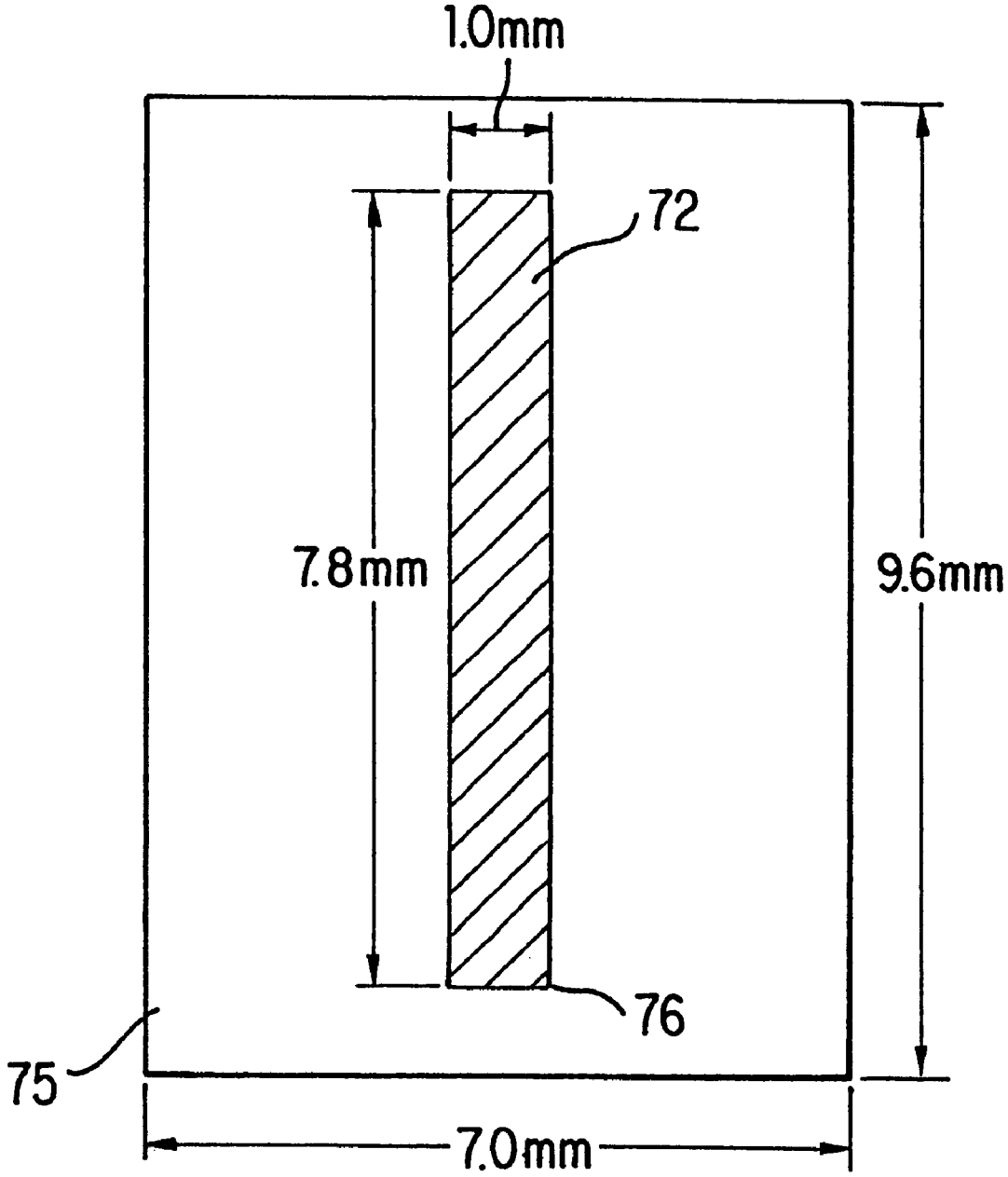
FIG. 14 is a schematic plan view of the reference mark of FIG. 13.

The mount section 71 of the reference mark is formed from the same engineering plastics material as the service station carriage 24 and is black in colour since black has a very low reflectance of light. It extends upwardly away from the wall 49 has a flat upper surface 72 which defines two holes 73. The insert section 70 of the reference mark is formed from a plastics material which is white in colour (due the very high reflectance of white surfaces) and has two legs 74 which extend downwardly away from a flat land section 75 of the insert 70. The flat land 75 defines a rectangular slot 76, best seen in FIG. 14, of dimensions 7.8 mm by 1.0 mm. The land 75 is 9.6 mm by 7.0 mm. The insert 70 can be placed within the mount 71 by inserting the legs 74 into the holes 73 in the mount 71 and is shown in its installed position in FIG. 10 and at a larger scale in FIG. 13.

Other parts of the service station carriage 24 are chosen to be black in colour to ensure that they do not reflect stray light from the optical sensor since such reflections could provide false signals to the optical sensor.

Figure 15A:
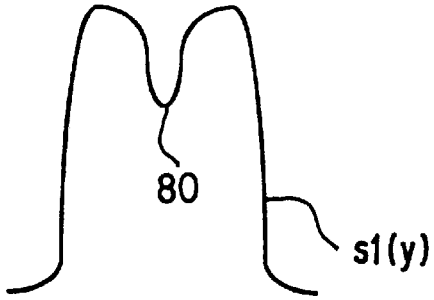
FIG. 15A is a schematic representation of the optical sensor readings taken as an optical sensor is scanned over a reference mark.

As can be seen the longer side of the slot 76 runs perpendicularly to the scanning direction (the Y direction) of the printer carriage 10 so that as the optical sensor 17 of the printer carriage 10 scans past the reference mark the colour change from white to black is "seen" by the sensor (due to the large change in reflectance between a black and a white surface) followed a second colour change from black to white. These reflectance or colour changes generate a set of optical sensor readings of the type shown in FIG. 15 where the value of the sensor reading S is plotted against the Y position of the printer carriage 10 to give the curve labelled sl(y). As will be appreciated the central dip 80 in the curve is due to the optical sensor 17 scanning the black band of the mount 71 within the white background of the insert 70. The minimum of this central dip corresponds to the centre of the reference mark and the Y coordinate of this location of the printer carriage is what is sought by the following procedures. Three alternative procedures called A1, A2 and A3 for determining the y position of the turning point 80 of the central dip are described in copending Ser. No. 09/031,115 with reference steps 100–105 as shown in the flowcharts of to FIGS. 16, 17 and 18 of said application.

Figure 15B:
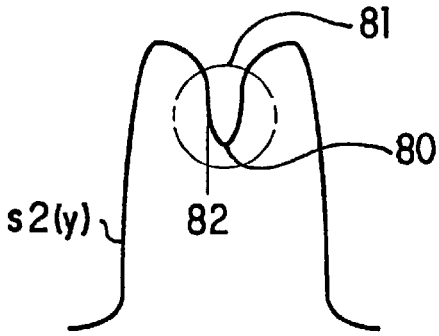
FIG. 15B is a schematic representation of the averaged values of the readings of FIG. 15A.

For example a first procedure called A1 commences by taking a moving average of the raw sensor readings (step 100) in which each particular reading is replaced by the mean of the five sensor readings either side of it resulting in the curve s2(y) shown in FIG. 15B. The y coordinate of the point 80 on s2(y) is then found by fitting a parabola to the area of the curve labelled by circle 81. First, however the starting point for fitting the parabola, labelled as 82, must be found.

Figure 15C:
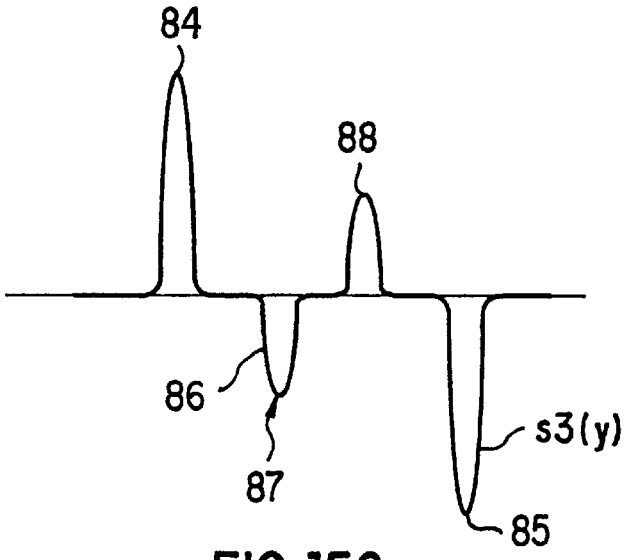
FIG. 15C is a schematic representation of the differential of the averaged values of the readings of FIG. 15B.

To facilitate this the curve labelled s2(y) is differentiated (step 101) to yield the curve labelled s3(y) shown in FIG. 15C, since the differential function is likely to be less affected by noise than the original readings. A check (step 102) is then performed on the differential function to ensure that this set of readings are valid. The maximum 84 and minimum 85 of the differential function s3(y) are found and the difference between these figures is compared to an empirically determined value minGap. If the difference is greater than minGap, procedure A1 is continued, if not the sensor readings are discarded and the procedure is restarted. If this check is repeatedly failed, an error message is given to the operator. Since the maximum and minimum values correspond to the edges of the reference mark, this check should ensure that there is a reference mark mounted on the service station carriage 24, that it is has been correctly positioned for calibration and that the reference mark has been correctly "read" by the optical sensor. Once this check has been passed, starting from the lower values of s3(y), all values that are greater than an empirically determined value−k are discarded until the value−k is encountered (step 103). The value of−k is chosen by trial and error to give a point 86 on the s3(y) curve which is approximately halfway down the smaller minimum as shown in FIG. 15C.

The precise location of the point 86 is not critical to procedure A1 since it merely determines the starting point for the fitting of the parabola. This starting point, determined from the differential curve s3(y), is then used to fit a parabola to the s2(y) curve (step 104). The turning point of the parabola is then found by standard means (step 105). Although a parabola has been chosen for simplicity, it should be noted that any standard function with a turning point can be utilised.

The present technique for aligning a printer carriage with a service station in the carriage scan axis may be utilised at any convenient moment during the operation of the printer to check or recalibrate the location of the printer carriage to the service station. Alternatively, or additionally, the technique may be utilised when a service station component or a component affecting the Y axis of the printer (e.g. the encoder strip) is replaced or serviced. Alternatively, or additionally, the technique may be utilised during the construction or initial assembly of the printer in which case the final calibration is stored within the printer and utilised for the lifetime of the printer.

Figure 16:
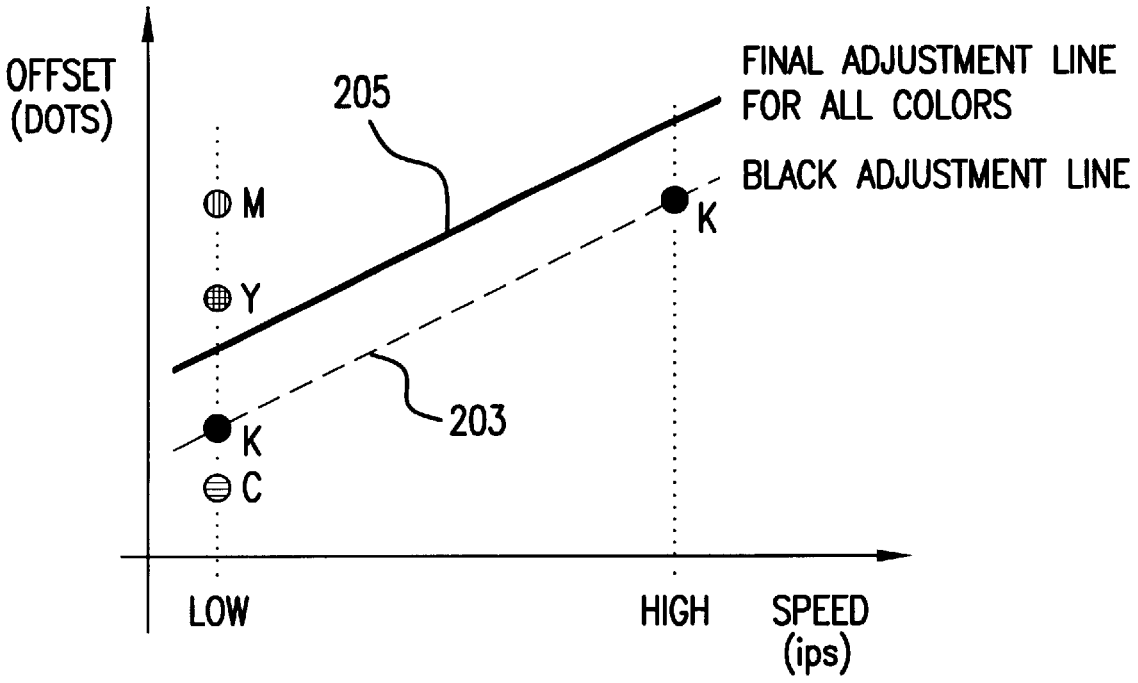
FIG. 16 is a schematic chart showing how the adjustment for bi-directional color printing is extrapolated from data taken from a bi-directional black printing pattern.
Figure 17A:
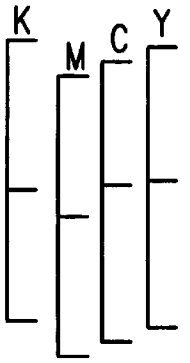
FIGS. 17A, 17B, and 17C show a schematic representation of swath height optimized pen alignment.
Figure 17B:
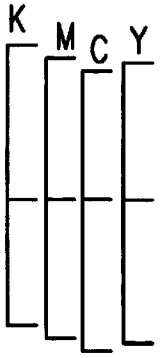
Figure 17C:
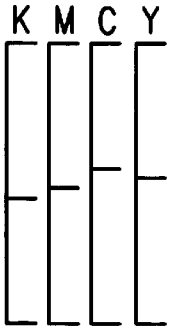
Figure 19:
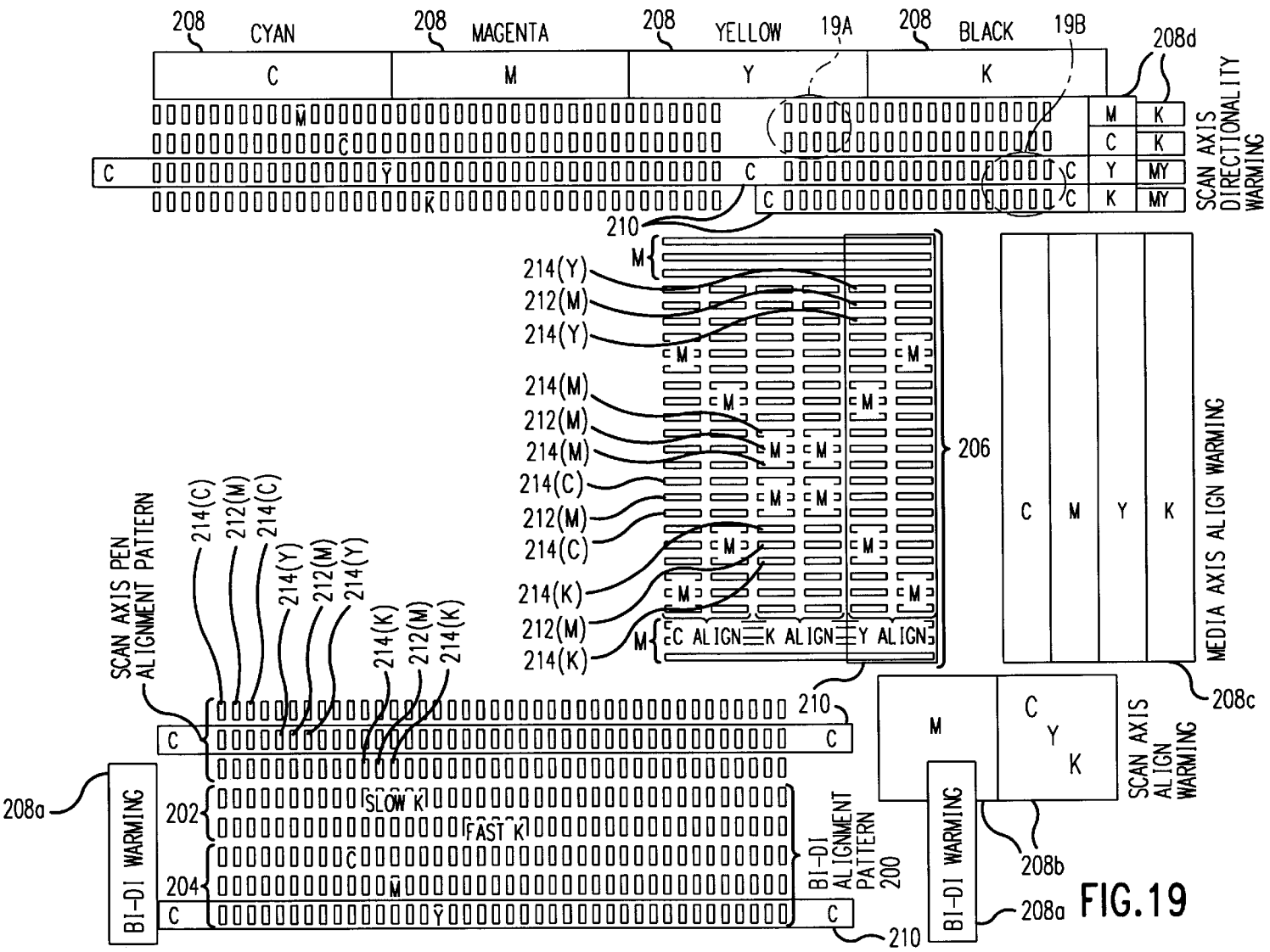
FIG. 19 and its magnitude portions 19A, 19B, 19C, 19D, and 19E show an exemplary color printout of an actual calibration test pattern incorporating the features of the present invention.

The present color test pattern employs a bi-directional color alignment algorithm. This algorithm uses a bi-di pattern 200 as shown in FIG. 19 to measure the different bi-directional offsets for the black and the colors and then optimizes the bi-directional adjustment for all the colors as shown in the graph of FIG. 16. The algorithm measures the offset for the black pen at 2 speeds (low and high) 202 and finds a a straight line 203 passing through the two offsets, then assumes that the slope will be similar to the other pens (as they have the same architecture and behavior) and measures the color offset at low speed 204, then it centers the final adjustment line 205 among the offsets. (See FIG. 16).

The present test pattern technique also uses one pattern 206 to make two different measurements. In the present embodiment, the same pattern is used to make two different measurements: paper axis pen alignment and swath height error measurement.

It also provides print warming areas 208 as well as bi-directional warming 208*a,* scan axis alignment warming 208*b,* media axis alignment warming 208*c,* and scan axis directionality warming 208*d* which are all respectively located just before printing measurement areas. To ensure pen stability and that the measurements taken are representative to the printing conditions, some specific warming areas are printed just before printing the measurement patterns. This strategy is used in all the patterns on the present composite test patterns.

Another feature is to print a pattern and scan the printed pattern with minimum dry time. To speed up all the alignment process, some special layout on the patterns has been designed to minimize printing and scanning time. These improvements include print pattern for each pen in the same row, scan the patterns just after printing them, and print the paper axis patterns in the middle of the pinch rollers. This allows for faster scanning and avoids having a dry time.

We also use background color printing to improve measurement robustness. To minimize impact of ambient light on the he scanning method and improve the signal to noise ratio, we print a controlled background (cyan) 210 that minimizes the ambient light reflections.

Another feature provides swath height optimized paper axis pen alignment. To align the pens in the paper axis, rather than optimize the pen center alignments (which has been the usual approach) we will center the pen extremums to minimize the SH differences between pens. So, if the pen is really symmetrical, the result will be the same but if not, the swath heights will be centered on the range. (See FIGS. 17A–17C).

Figure 18:
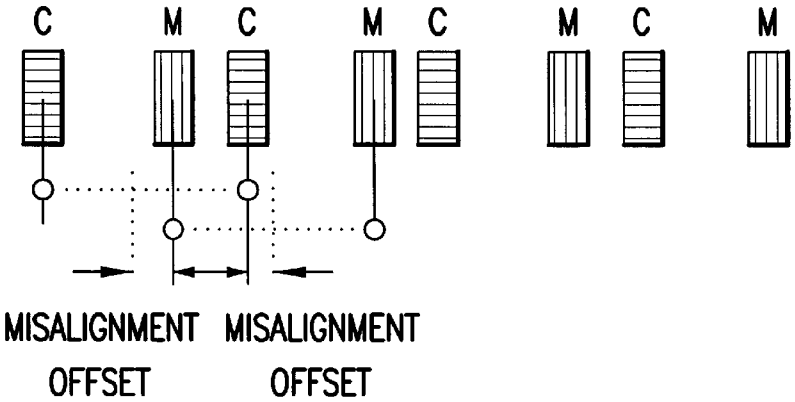
FIG. 18 is a schematic showing the use of subset printing patterns to provide relative rather than absolute data measurements.

Finally we provide interlaced and repeated patterns for measuring misalignments. As shown in FIG. 19, the system and method of the present invention employs a test pattern having a series of horizontally and vertically spaced-apart bars printed by different color ink printheads and scanned by an optical sensor. Each series of test patterns incorporates repeated subsets of sample print marks so that two samples 214 from one printhead are compared to a common reference sample 212 associated with each of said subsets. To minimize the effects of scan axis servo errors, sampling errors and improve the final measurement accuracy, we use a special technique consisting in measure a lot of time the same magnitude and make all the measurements relative (in opposition to make them absolute). For example, if we want to measure the misalignment in scan axis between magenta and cyan, the pattern is shown in FIG. 18. These measurements are all relative. We always compare the mean between two block centers of sample print marks in comparison to a block center of a common reference sample. In our exemplary test patterns of FIG. 19, the center reference sample shown as block 212 is always magenta and is interlaced between pairs of sample print marks 214 to form subset groups of three blocks. Outer spaced-apart bars which serve as sample print marks shown as blocks 214 are in all colors including magenta. Then this measurement is repeated a lot of times along the scan axis or the media advance axis to minimize the effect of local problems and to reduce the noise in the measurement.

Figure 19A:
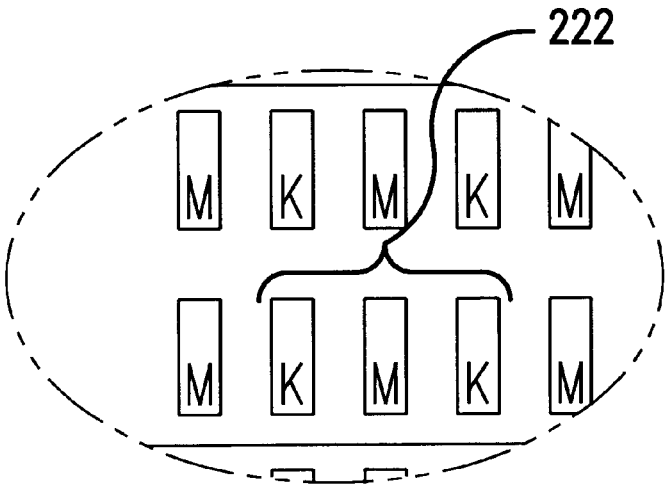
Figure 19B:
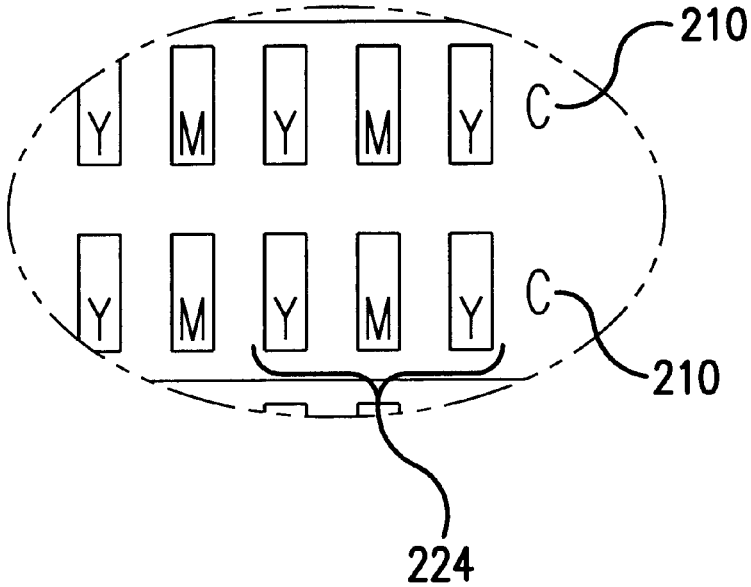
Figure 19C:
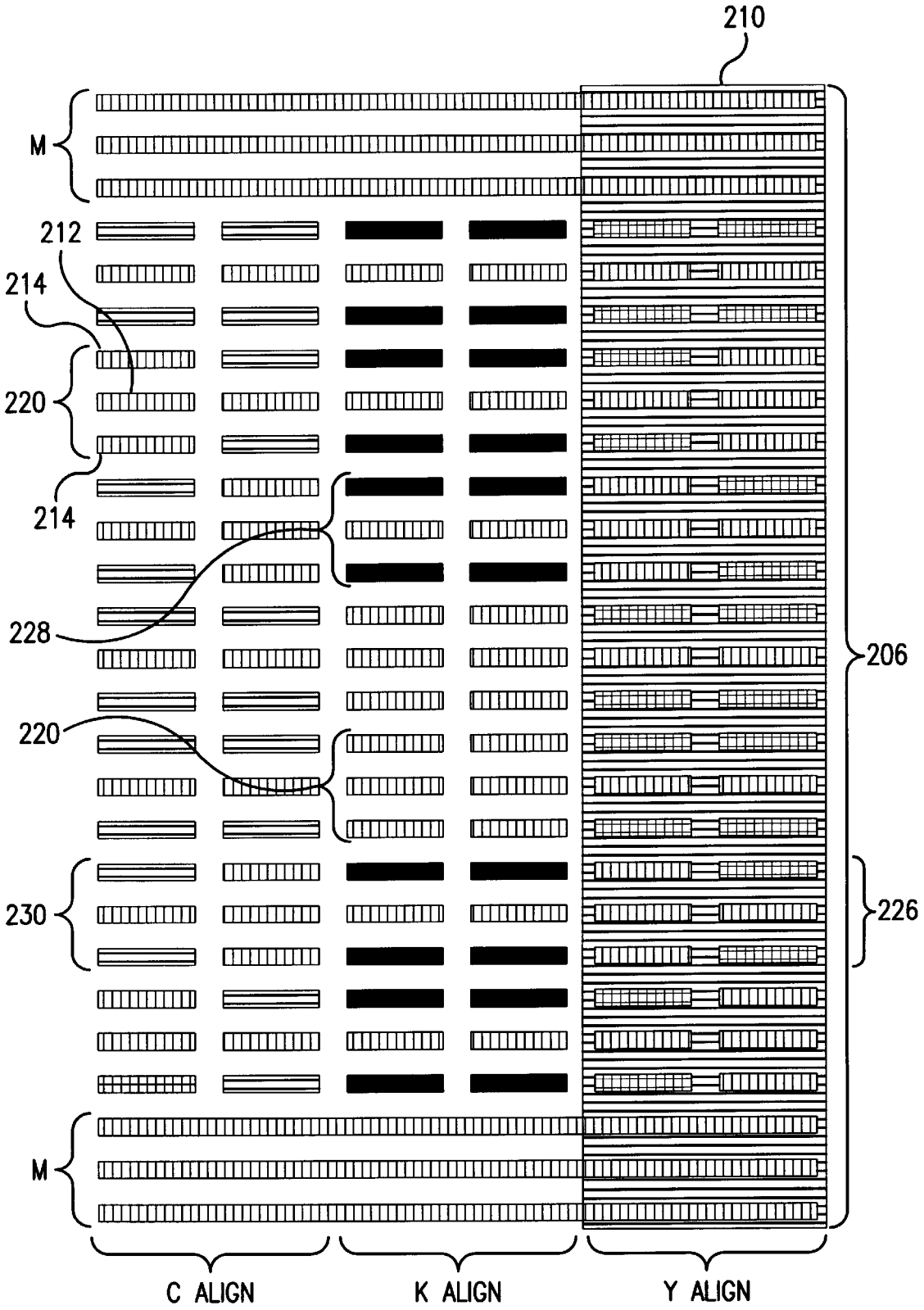
Figure 19D:
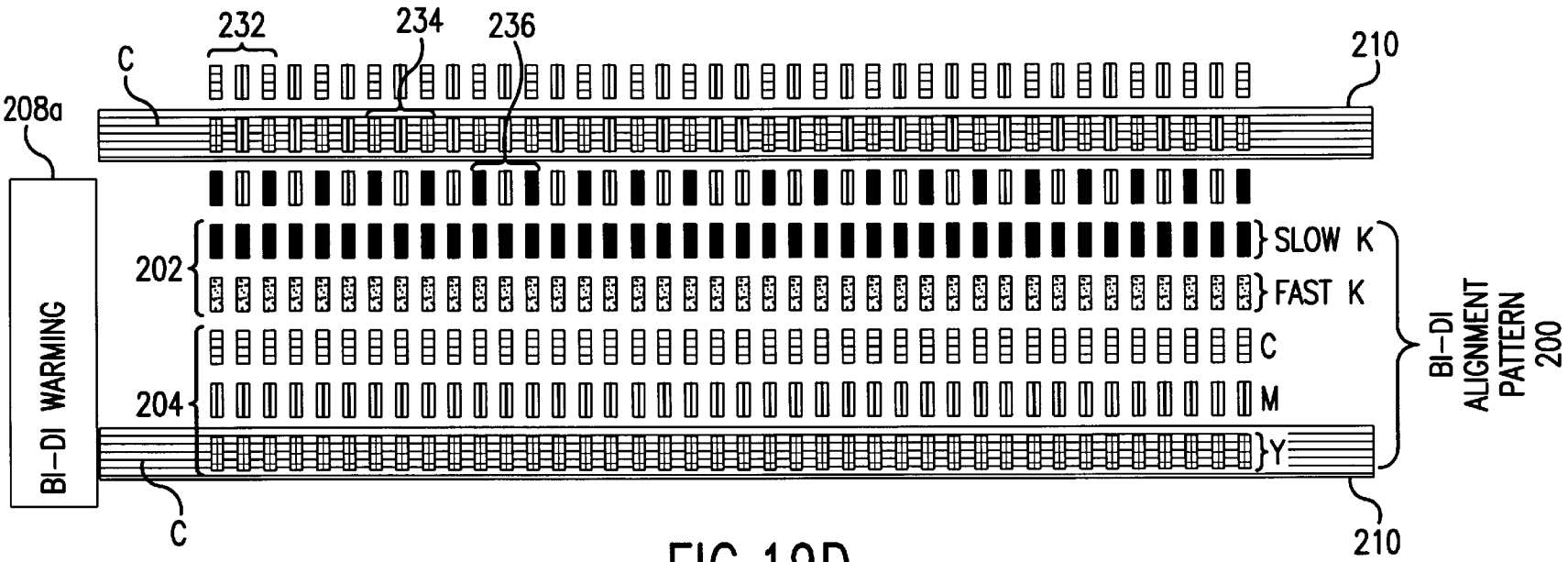
Figure 19E:
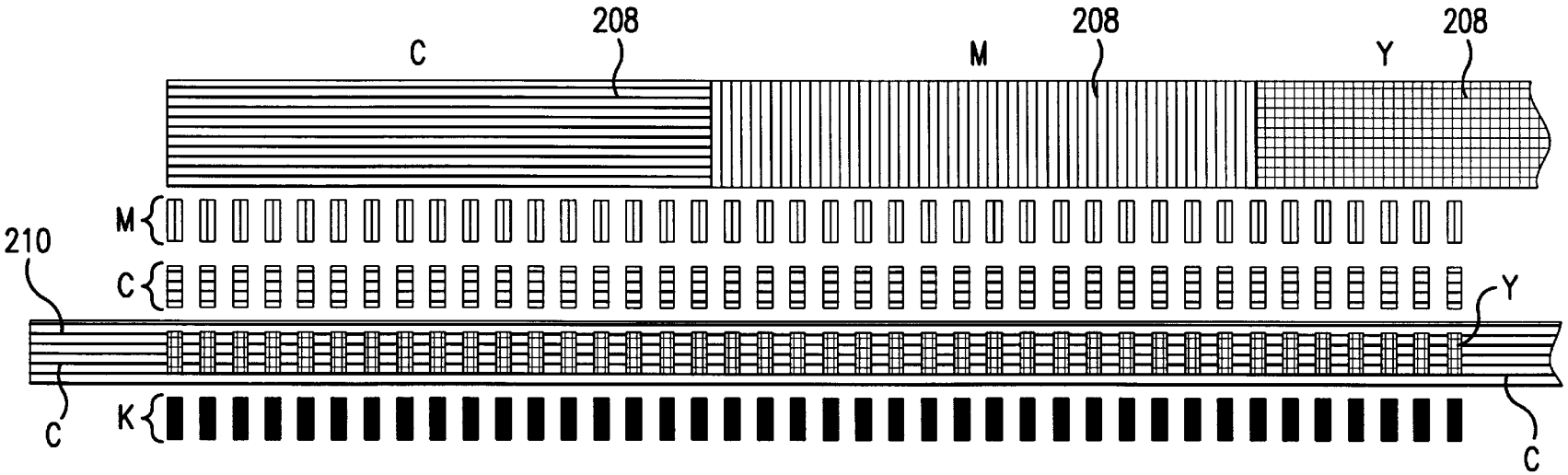

Since the four exemplary print cartridges 16 of FIG. 2 each hold ink of a different color such as black (K), cyan (C), magenta (M) and yellow (Y), respectively, it will be understood that all sample markings of a particular color shown in the exemplary test pattern of FIG. 19 originate from the same printhead. Since the actual color test pattern of FIG. 19 has been illustrated with a conventional black & white rendering, the color abbreviation letters K C M Y are used in the test pattern drawings of FIGS. 19, 19A, 19B, 19C, 19D and 19E in order to clearly indicate which color print cartridge is printing individual sample markings in the test pattern. As shown in the magnified closeup drawing of FIG. 19C, a subset 220 in the form of multiple spaced apart bars includes the reference sample 212 and the sample print marks 214 printed in the same color by the M printhead. The following magnified closeup drawings illustrate repeated subset patterns of sample markings in the form of multiple spaced-apart bars where the magenta reference sample 212 from the M printhead is a different color from the sample print marks 214 of the C, Y and K printheads: FIGS. 19A–B show subsets 222, 224; FIG. 19C shows subsets 228, 230; and FIG. 19D shows subsets 232, 234, 236.

What is claimed is:

1. An inkjet printing system comprising:

a scanning carriage having a plurality of different ink printheads mounted therein for printing on media in a print zone;

an optical sensor capable of scanning across the media in a scanning zone;

a test pattern printed by said printheads and scanned by said sensor, said test pattern incorporating repeated subsets of sample print marks wherein a location of at least two spaced apart samples from one printhead which form a subset are each separately compared to a different location of a common reference sample associated with such subset in order to achieve alignment calibration between said different ink printheads.

2. The printing system of claim 1 wherein said scanning carriage has a scanning direction, and wherein said test pattern comprises repeated subsets of the sample print marks extending in said scanning direction to achieve alignment calibration in said scanning direction.

3. The printing system of claim 1 wherein said media moves in a media advance direction through said print zone, and wherein said test pattern comprises repeated subsets of the sample print marks extending in said media advance direction to achieve alignment calibration in said media advance direction.

4. The printing system of claim 1 wherein each subset includes said common reference sample located between said two spaced apart samples.

5. The printing system of claim 1 wherein said common reference sample and said sample print marks in each subset are printed by a same printhead.

6. The printing system of claim 1 wherein said common reference sample and said sample print marks in each subset are printed by different printheads, respectively.

7. The printing system of claim 1 wherein said common reference sample and said sample printmarks in each subset are printed in different color inks, respectively.

8. The printing system of claim 1 wherein said common reference sample is printed in a color taken from a group consisting of cyan, magenta, yellow and black inks.

9. The printing system of claim 1 wherein each different printhead prints a test pattern of said sample printmarks along different rows, respectively, extending in a carriage scan direction.

10. The printing system of claim 1 wherein each different printhead prints a test pattern of said sample printmarks along different columns, respectively, extending in a media advance direction.

11. A method of calibrating a first inkdrop location of at least one printhead relative to a second inkdrop location of a second printhead comprising:

printing a first calibration pattern formed by a series of spaced-apart bars which are in aligned proximity and are generated from the at least one printhead;

printing a second calibration pattern formed by a series of spaced-apart bars which are in aligned proximity and are generated from the second printhead;

printing a first reference mark in close proximity to said first pattern of spaced-apart bars, wherein multiple ones of said first reference mark are interlaced in said first pattern;

printing a second reference mark in close proximity to said second pattern of spaced-apart bars, wherein multiple ones of said second reference mark are interlaced in said second pattern;

providing an alignment calibration by comparing the locations of the first and second patterns of spaced-apart bars with the locations of the first and second reference marks, respectively.

12. The method of claim 11 wherein at least a portion of said first pattern of spaced-apart bars extends in a printhead scanning direction.

13. The method of claim 11 wherein said first reference mark is located between two spaced-apart bars in said first pattern.

14. The method of claim 11 wherein at least a portion of said second pattern of spaced-apart bars extends in a media advance direction.

15. The method of claim 11 wherein said second reference mark is located between two spaced-apart bars in said second pattern.

16. The method of claim 11 wherein said first and second reference marks are the same color, which same color is different from the color of the first or second patterns.

17. The method of claim 11 wherein said first and second patterns of spaced-apart bars are different colors as compared with a color of said first and second reference marks, respectively, with at least some of both first and second patterns having vertically spaced-apart bars.

18. The method of claim 16 wherein at least a portion of said first and second patterns of spaced-apart bars are said same color of said first and second reference marks, with at least some of both first and second patterns having horizontally spaced-apart bars.

19. The method of claim 11 wherein at least a portion of said first pattern of said spaced-apart bars are a different color than said first reference mark, and at least a portion of said second pattern of said spaced-apart bars are a different color than said second reference mark, with at least some of both first and second patterns having both horizontally spaced-apart bars and vertically spaced-apart bars.

* * * * *